US011788531B2

(12) United States Patent
Park et al.

(10) Patent No.: US 11,788,531 B2
(45) Date of Patent: Oct. 17, 2023

(54) SCROLL COMPRESSOR

(71) Applicant: LG Electronics Inc., Seoul (KR)

(72) Inventors: Sangbaek Park, Seoul (KR); Yoonsung Choi, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/149,994

(22) Filed: Jan. 4, 2023

(65) Prior Publication Data

US 2023/0279861 A1 Sep. 7, 2023

(30) Foreign Application Priority Data

Mar. 3, 2022 (KR) ..... 10-2022-0027606

(51) Int. Cl.
*F04C 18/02* (2006.01)
*F04C 29/12* (2006.01)

(52) U.S. Cl.
CPC ..... *F04C 29/124* (2013.01); *F04C 18/0215* (2013.01)

(58) Field of Classification Search
CPC .. F04C 18/0215; F04C 18/0269; F04C 18/02; F04C 18/0261; F04C 29/124; F04C 29/12; F04C 29/0057; F04C 23/008; F04C 2240/40; F04C 2240/30; F04C 2240/20; F04C 2240/80; F04C 2250/10; F04C 2250/20
See application file for complete search history.

(56) References Cited

U.S. PATENT DOCUMENTS

| | | | | |
|---|---|---|---|---|
| 9,890,784 | B2 * | 2/2018 | Duppert | F04C 18/0215 |
| 2017/0306955 | A1 | 10/2017 | Choi et al. | |
| 2019/0301461 | A1 * | 10/2019 | Yamashita | F04C 29/0021 |
| 2020/0095994 | A1 * | 3/2020 | Kim | F04C 18/0269 |

FOREIGN PATENT DOCUMENTS

| | | |
|---|---|---|
| DE | 112014005641 | 9/2016 |
| EP | 2192303 | 6/2010 |
| JP | H05-215085 | 8/1993 |
| JP | H05-263775 | 10/1993 |
| JP | 2010-077917 | 4/2010 |
| KR | 10-2017-0122016 | 11/2017 |
| KR | 10-2182170 | 11/2020 |

OTHER PUBLICATIONS

Office Action in Korean Appln. No. 10-2022-0027606, dated May 26, 2023, 12 pages(with English translation).
Extended European Search Report in European Appln. No. 22217249.6, dated Aug. 2, 2023, 5 pages.

* cited by examiner

*Primary Examiner* — Audrey B. Walter
*Assistant Examiner* — Dapinder Singh
(74) *Attorney, Agent, or Firm* — Fish & Richardson P.C.

(57) ABSTRACT

Provided is a scroll compressor. The scroll compressor includes a reinforcing unit between an outlet end of a suction port and an outer circumferential surface of the fixed wrap facing the outlet end of the suction port. The reinforcing unit may overlap a part of the outlet end of the suction port in a radial direction when being projected in an axial direction. Accordingly, rigidity of a suction side of the fixed wrap is increased, and thus, deformation of the suction side of the fixed wrap during operation of the scroll compressor may be suppressed to increase reliability of the scroll compressor.

20 Claims, 12 Drawing Sheets

SCROLL COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2022-0027606, filed on Mar. 3, 2022, the contents of which are incorporated by reference herein in their entirety.

TECHNICAL FIELD

The present disclosure relates to a scroll compressor, and more particularly, a scroll compressor having a suction valve.

BACKGROUND

A compressor adopted to a refrigeration cycle of a refrigerator, an air conditioner, etc. performs a function of compressing and transmitting refrigerant gas to a condenser. A rotary compressor or a scroll compressor is applied to an air conditioner.

The scroll compressor may be classified into a hermetic scroll compressor in which a driving unit (or a motor part) and a compression unit are included together in a casing, and an open-type scroll compressor in which a driving unit (or a motor part) is included outside a casing and only a compression unit is included in the casing.

The scroll compressor may be classified into a top compression type scroll compressor and a bottom compression type scroll compressor according to locations of a driving motor, constituting a driving unit or a motor part, and a compression unit. The top compression type scroll compressor is a compressor type in which a compressor is located above a driving motor, and the bottom compression type scroll compressor is a compressor type in which a compression unit is located below a driving motor. This classification is based on an example in which a casing is installed as a vertical type or a standing type. When a casing is installed as a horizontal type, a left side may be classified as an upper side and a right side may be classified as a lower side for convenience.

The scroll compressor may be respectively classified into a low-pressure type scroll compressor in which an inner space of a casing including a compression unit provides suction pressure and a high-pressure type scroll compressor providing discharge pressure. The top compression type scroll compressor may be configured as a low-pressure type or a high-pressure type. However, the bottom compression type scroll compressor is generally configured as a high-pressure type scroll compressor in consideration of a position of a refrigerant suction pipe.

The high-pressure type scroll compressor is directly connected to a suction pressure chamber constituting a compression chamber such that a refrigerant suction pipe penetrates through a casing. As the suction pressure chamber is provided at an edge of a fixed scroll, the edge of the fixed scroll adjacent to a refrigerant suction pipe is contact with cold refrigerant and shrinks. whereas a center portion far apart from the refrigerant suction pipe constitutes a discharge pressure chamber and is expanded by high-temperature refrigerant. Thus, the fixed scroll is bent in a direction in which the center portion is far apart from an orbiting scroll, and a suction end of the fixed wrap and a suction end of the orbiting wrap both constituting a suction pressure chamber may be in excessively close contact, and thus, damaged.

Accordingly, some compressors provide a type of a friction-avoidance groove such as a chamfer in some sections of a fixed wrap and an orbiting wrap. However, this may cause complex wrap machining and deteriorated wrap strength in the corresponding sections.

In addition, in these compressors, an end (a suction end) of the fixed wrap is provided on a side surface of a fixed scroll to fully pass through a suction port in a radial direction. However, since a length of the fixed wrap having a small thickness is elongated, rigidity at a suction side of the fixed scroll may not be ensured. In addition, when the compressor stops, refrigerant in a compression chamber flows back. Thus, when load near the suction end greatly increases, it would be difficult to ensure reliability.

Additionally, in some compressors, an end (a suction end) of the fixed wrap is provided on a side surface of the fixed scroll to fully pass through a suction port in a radial direction. However, since refrigerant passing through the suction port moves along a wrap providing direction toward a starting end (a discharge end) of the fixed wrap (a discharge end), suction loss due to vortex may occur at an opposite side of a suction direction of the refrigerant.

In addition, in some compressors, when the compressor stops operation, the refrigerant in a discharge pressure chamber flows back toward a suction pressure chamber. Thus, reverse rotation of an orbiting scroll may occur, and dead volume may increase and performance of the compressor may deteriorate due to lack of oil.

SUMMARY

Therefore, the present disclosure describes a scroll compressor capable of increasing rigidity at a suction side of a fixed scroll.

The present disclosure also describes a scroll compressor that may facilitate machining of a fixed wrap and increase rigidity at a suction side of a fixed scroll.

The present disclosure also describes a scroll compressor that may increase rigidity at a suction side of a fixed scroll and suppress suction loss.

The present disclosure also describes a scroll compressor that may increase rigidity at a suction side of a fixed scroll and suppress refrigerant or oil in a compression chamber from flowing back to the suction side.

In order to achieve these and other advantages and in accordance with the purpose of this specification, as embodied and broadly described herein, there is provided a scroll compressor including a casing, a driving motor, a rotating shaft, a fixed scroll. and a refrigerant suction pipe. The driving motor may be included inside the casing. The rotating shaft may be coupled to a rotor of the driving motor. An orbiting scroll may be coupled to the rotating shaft in the casing and include an orbiting wrap to perform an orbiting. The fixed scroll may be included in the casing, include a fixed wrap engaged with the orbiting wrap to provide a compression chamber in a helical form, and a suction port may be inserted through the fixed scroll from an outer circumferential surface to an inner circumferential surface toward an outer side surface of the fixed wrap to communicate with the compression chamber. A refrigerant suction pipe may penetrate through the casing and inserted into an inlet end of the suction port, A reinforcing unit may be provided between an outlet end of the suction port and an outer circumferential surface of the fixed wrap facing the outlet end of the suction port, and extend from the outlet end of the suction port toward an outer circumferential surface of the fixed wrap, and The reinforcing unit may overlap a part of the outlet end of the suction port in a radial direction when being projected in an axial direction. Accordingly, rigidity of a suction side of the fixed wrap is increased, and thus, deformation of the suction side of the fixed wrap during operation of the scroll compressor may be suppressed to increase reliability of the scroll compressor.

A discharge port may be provided in a center portion of the fixed scroll. The reinforcing unit may extend along a circumference of the suction port from a downstream end of the outlet end of the suction port to an upstream end at an opposite side of the downstream end, the downstream end being an end spaced far apart from the discharge port along a wrap providing direction of the fixed wrap. Accordingly, rigidity of a suction side of the fixed wrap is increased and occurrence of vortex near the outlet end of the suction port may be suppressed. Therefore, reduction in volumetric efficiency may be suppressed.

In detail, the reinforcing unit may overlap the suction port in correspondence with 50% of an inner diameter of the suction port or less. Accordingly, rigidity of a suction side of the fixed wrap may be increased and suction resistance may be minimized. Therefore, high volumetric efficiency may be ensured.

As another example, the reinforcing unit may be provided with a suction guide groove recessed from the outlet end of the suction port toward the outer circumferential surface of the fixed wrap. Accordingly, rigidity of a suction side of the fixed wrap may be increased and a large suction port area may be ensured. Therefore, volumetric efficiency may be increased.

In detail, the suction guide groove may be provided to be inclined from one side of the outlet end of the suction port toward the fixed wrap. Accordingly, suction refrigerant may be guided to be smoothly sucked, and thus, volumetric efficiency may be increased.

In detail, the suction guide groove may be provided to have a plane shape or a circumferential shape. Accordingly, the suction guide groove may be easily machined and suction refrigerant may be guided to be smoothly sucked. Thus, volumetric efficiency may be increased.

In addition, the suction guide groove may be radially recessed at the outlet end of the suction port to a preset depth. Accordingly, a suction port area may be enlarged, and thus, volumetric efficiency may be increased.

In detail, a radial side surface of the suction guide groove may be provided to have a plane surface. Accordingly, the reinforcing unit may be provided, and meanwhile a suction port area may be enlarged at maximum. Thus, rigidity of the fixed wrap may be enhanced and volumetric efficiency may be increased.

As another example, the fixed scroll may include a fixed end plate and a fixed side wall. The fixed end plate may include a discharge port in a center portion. The fixed side wall may be provided on one side surface of the fixed end plate to have an annular shape and surround the fixed wrap. An inflection point of a circular arc surface may connect a suction end of the fixed wrap to an inner circumferential surface of the fixed side wall and be located within a circumferential range of the suction port. Accordingly, a length of the fixed wrap may be reduced and a thickness of the suction port may be increased. Thus, rigidity of the fixed wrap may be increased.

In detail, the inflection point may be provided in a portion spaced far apart from the discharge port with reference to a first center line passing through a center of the suction port. Accordingly, rigidity of the fixed wrap may be enhanced and suction refrigerant may smoothly move toward a compression chamber. Thus, volumetric efficiency may be increased.

In detail, the inflection point may be provided in a position such that an overlapping length from an end of the reinforcing unit to an end of the suction port located far apart from the discharge port is 50% of an inner diameter of the suction port or less. Accordingly, the fixed wrap may be connected to the suction port and a suction port area may be ensured. Thus, rigidity of the fixed wrap may be enhanced and deterioration of volumetric efficiency may be suppressed.

As still another example, the suction port may include a suction valve configured to open or close the suction port. Accordingly, rigidity of the fixed wrap may be enhanced and refrigerant or oil may be suppressed from flowing back when the compressor stops operation. Thus, reverse rotation of an orbiting scroll may be suppressed, and deterioration of compressor performance due to refrigerant or oil flowing back may be suppressed.

In detail, the suction valve may include a valve pipe and a valve member. The valve pipe may open toward the compression chamber and be inserted into the suction port. The valve member may be hinged to the valve pipe to be detachably attached to an end of the valve pipe and configured to open or close the suction port. Accordingly, the reinforcing unit may be provided, and meanwhile the suction valve may be easily installed at the suction port to suppress the refrigerant or oil from flowing back.

In detail, the suction valve may include a valve pipe and a valve member. The valve pipe may include a suction through hole open toward the compression chamber to be inserted into the suction port. The valve member may be slidably inserted into the valve pipe to open or close the suction through hole and configured to open or close the suction port. Accordingly, the reinforcing unit is provided, and meanwhile the suction valve may be easily installed at the suction port and reliability of operation of the suction valve may be enhanced. Thus, the refrigerant or oil may be effectively suppressed from flowing back.

As still another example, the suction port may be provided in a circumferential direction with reference to an axial center of the rotating shaft. Accordingly, a length of the suction port may be minimized, and thus, the suction port may be easily machined.

As still another example, the suction port may be provided to be inclined in a direction toward a center of the fixed scroll with reference to a wrap providing direction of the fixed wrap off the axial center of the rotating shaft. Accordingly, a structure of the suction port may be simplified, and meanwhile a suction port area may be enlarged. Thus, volumetric efficiency may be increased.

As still another example, the suction port may include a first suction unit constituting the inlet end and the second suction unit constituting the outlet end. A cross-sectional area of the second suction unit may be provided to be larger than a cross-sectional area of the first suction unit. Accordingly, the suction port may be provided in a radial direction, and meanwhile an area of an outlet of the suction port may be enlarged. Thus, volumetric efficiency may be increased.

DETAILED DESCRIPTION

Description will now be given in detail of a scroll compressor disclosed herein, with reference to the accompanying drawings. In the following description, a description of some components may be omitted to clarify features of the present disclosure.

In addition, the term "upper side" used in the following description refers to a direction away from a support surface for supporting a scroll compressor according to an implementation of the present disclosure, that is, a direction toward a driving unit (motor part or driving motor) when viewed based on the driving unit (motor part or driving motor) and a compression part. The term "lower side" refers to a direction toward the support surface, that is, a direction toward the compression part when viewed based on the driving unit (motor part or driving motor) and the compression part.

The term "axial direction" used in the following description refers to a lengthwise (longitudinal) direction of a rotating shaft. The "axial direction" may be understood as an up and down (or vertical) direction. The term "radial direction" refers to a direction that intersects the rotating shaft.

Hereinafter, a hermetic scroll compressor in which a driving unit (or a motor part or a driving motor) and a compression unit are included in a casing is described as an example of the scroll compressor. However, an open-type compressor in which a driving unit (a motor part or a driving motor) is included outside the casing and connected to a compression unit in the casing may be also adopted as the scroll compressor.

In addition, hereinafter, a compressor which is a vertical-type scroll compressor, in which a motor part and a compression unit are arranged in a longitudinal axial direction, and also a bottom compression type scroll compressor, in which a compression unit is located below a driving unit (or a motor part or a driving motor), is described as an example. However, the description may be also applied to not only a horizontal type scroll compressor in which a driving unit (a motor part or a driving motor) and a compression unit are arranged in a left-right direction, but also a top compression type scroll compressor in which a compression unit is arranged above a driving unit (a motor part or a driving motor) are arranged.

In addition, hereinafter, a bottom compression type and high pressure scroll compressor in which a refrigerant suction pipe constituting a suction passage is directly connected to a compression unit and a refrigerant discharge pipe communicates with an inner space of a casing so that the inner space of the casing provides discharge pressure is described as an example.

Figure 1:
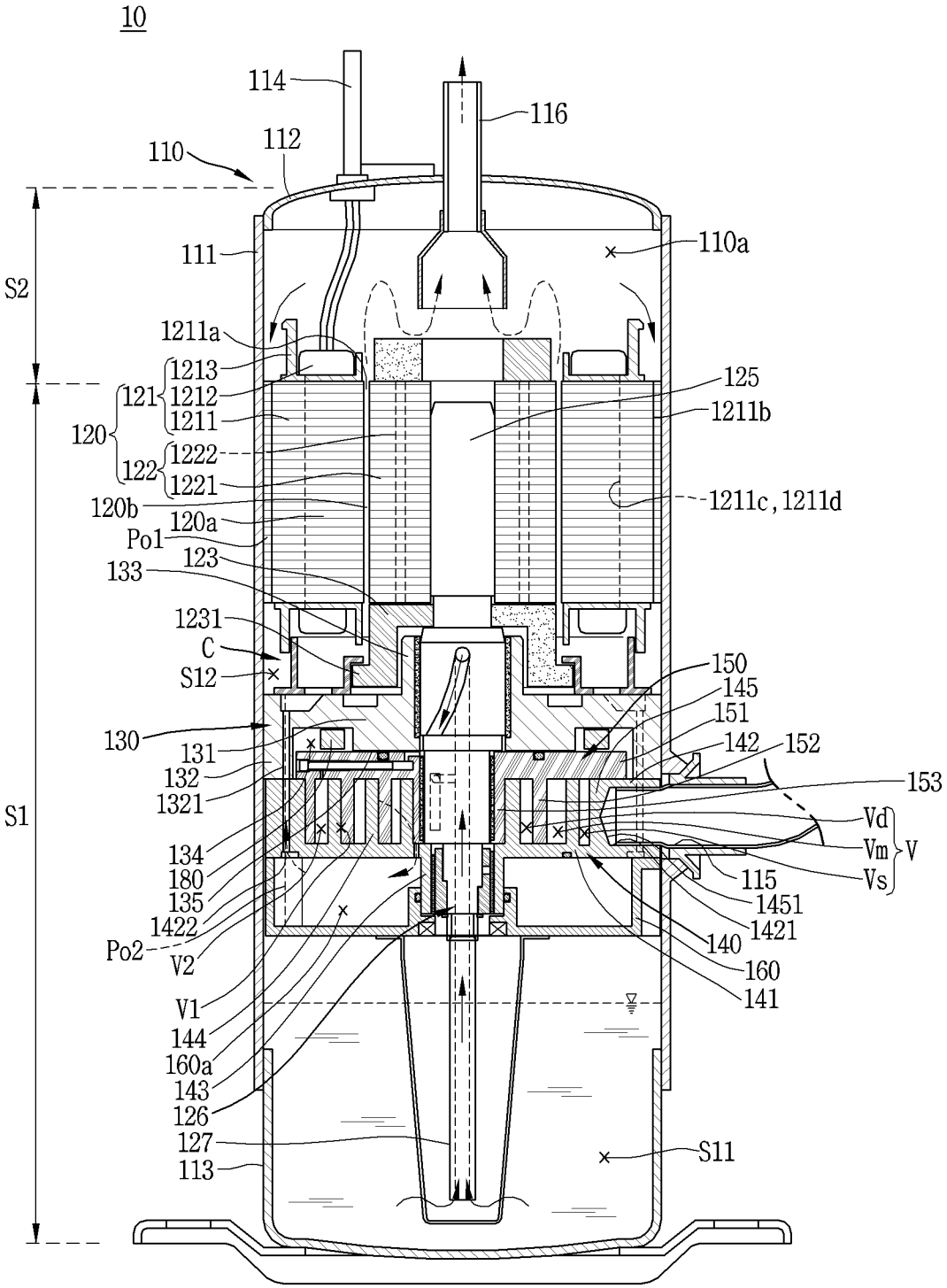
FIG. 1 is a longitudinal sectional view of a bottom-compression type scroll compressor in accordance with this implementation.

FIG. 1 is a longitudinal sectional view illustrating an inner structure of a scroll compressor in accordance with this implementation.

Referring to FIG. 1, a high-pressure and bottom-compression type scroll compressor (hereinafter, referred to as a scroll compressor) according to an implementation may include a driving motor 120 constituting a motor part disposed in an upper portion of a casing 110, and a main frame 130, a fixed scroll 140, an orbiting scroll 150, and a discharge cover 160 sequentially disposed below the driving motor 120. In general, the driving motor 120 may constitute the motor part, as described above, and the main frame 130, the fixed scroll 140, the orbiting scroll 150, and the discharge cover 160 may constitute a compression part C.

The driving motor 120 constituting the motor part is coupled to an upper end of a rotating shaft 125 to be described later, and the compression part C is coupled to a lower end of the rotating shaft 125. Accordingly, the compressor 10 constitutes the bottom-compression type structure described above, and the compression part C is connected to the driving motor 120 by the rotating shaft 125 to operate according to rotational force of the driving motor 120. Thus, the driving motor 120 may be understood as a driving unit configured to drive the compression unit C. Hereinafter, in the description, a driving motor may be also referred as a motor part or a driving unit.

Figure 2:
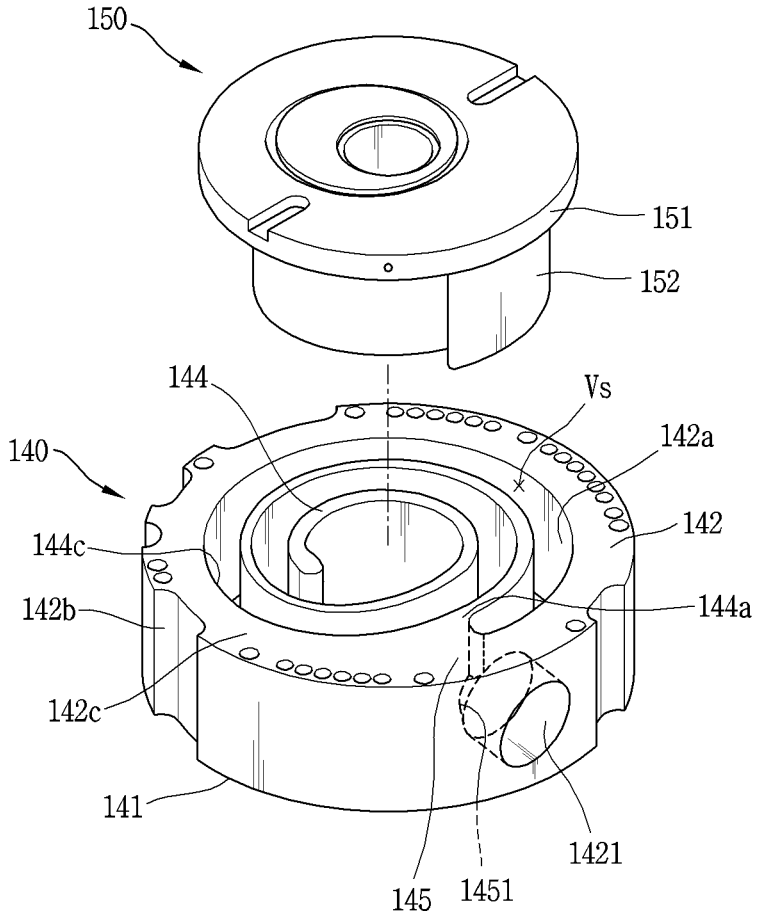
FIG. 2 is a detached perspective view of a fixed scroll and an orbiting scroll shown in FIG. 1.

Referring to FIG. 2, the casing 110 according to the implementation may include a cylindrical shell 111, an upper shell 112, and a lower shell 113. The cylindrical shell 111 may be formed in a cylindrical shape with upper and lower ends open. The upper shell 112 may be coupled to cover the open upper end of the cylindrical shell 111. The lower shell 113 may be coupled to cover the open lower end of the cylindrical shell 111. Accordingly, the inner space 110*a* of the casing 110 may be sealed. The sealed inner space 110*a* of the casing 110 may be divided into a lower space S1 and an upper space S2 based on the driving motor 120.

The lower space S1 may be a space defined below the driving motor 120. The lower space S1 may be further divided into an oil storage space S11 and an outflow passage S12 with the compression part C therebetween.

The oil storage space S11 may be a space defined below the compression part C to store oil or mixed oil in which liquid refrigerant is mixed. The outflow passage S12 may be a space defined between an upper surface of the compression part C and a lower surface of the driving motor 120. Refrigerant compressed in the compression part C or mixed refrigerant in which oil is contained may be discharged into the outflow passage S12.

The upper space S2 may be a space defined above the driving motor 120 to form an oil separating space in which oil is separated from refrigerant discharged from the compression part C. The upper space S2 may communicate with the refrigerant discharge pipe.

The driving motor 120 and the main frame 130 may be fixedly inserted into the cylindrical shell 111. An outer circumferential surface of the driving motor 120 and an outer circumferential surface of the main frame 130 may be respectively provided with an oil return passages Po1 and Po2 each spaced apart from an inner circumferential surface of the cylindrical shell 111 by a predetermined distance.

A refrigerant suction pipe 115 may be coupled through a side surface of the cylindrical shell 111. Accordingly, the refrigerant suction pipe 115 may be coupled through the cylindrical shell 111 forming the casing 110 in a radial direction.

The refrigerant suction pipe 115 may be formed in an L-like shape. One end of the refrigerant suction pipe 115 may be inserted through the cylindrical shell 111 to directly communicate with a suction port 1421 of the fixed scroll 140, which configures the compression part C. Accordingly, refrigerant can be introduced directly into a compression chamber V through the refrigerant suction pipe 115. The suction port 1421 to which the refrigerant suction pipe 115 is connected will be described later together with the fixed scroll 140.

An inner end of the refrigerant discharge pipe 116 may be coupled through an upper portion of the upper shell 112 to communicate with the inner space 110*a* of the casing 110, specifically, the upper space S2 defined above the driving motor 120.

The refrigerant discharge pipe 116 may be provided therein with an oil separator for separating oil from refrigerant discharged from the compressor 10 to the condenser 20, or a check valve for suppressing refrigerant discharged from the compressor 10 from flowing back into the compressor 10.

One end portion of an oil circulation pipe may be coupled through a lower end portion of the lower shell 113. Both ends of the oil circulation pipe may be open, and another end portion of the oil circulation pipe may be coupled through the refrigerant suction pipe 115. An oil circulation valve may be installed in a middle portion of the oil circulation pipe.

Hereinafter, a driving motor constituting the motor part will be described.

Referring to FIG. 1, the driving motor 120 according to the implementation may include a stator 121 and a rotor 122. The stator 121 may be fixed onto the inner circumferential surface of the cylindrical shell 111, and the rotor 122 may be rotatably disposed in the stator 121.

The stator 121 may include a stator core 1211 and a stator coil 1212.

The stator core 1211 may be formed in an annular shape or a hollow cylindrical shape and may be shrink-fitted onto the inner circumferential surface of the cylindrical shell 111.

A rotor accommodating portion 1211*a* may be formed in a circular shape through a central portion of the stator core 1211 such that the rotor 122 can be rotatably inserted therein. A plurality of stator-side return grooves 1211*b* may be recessed or cut out in a D-cut shape at an outer circumferential surface of the stator core 1211 along the axial direction and disposed at preset distances along a circumferential direction.

A plurality of teeth 1211*c* and slots 1211*d* may be alternately formed on an inner circumferential surface of the rotor accommodating portion 1211*a* in the circumferential direction, and the stator coil 1212 may be wound on each tooth 1211*c* by passing through the slots 1211*d* at both sides of the tooth 1211*c*.

Each slot (precisely, a space between adjacent stator coils in the circumferential direction) 1211*d* may define an inner passage 120*a*, and a gap passage 120*b* may be defined between an inner circumferential surface of the stator core 1211 and an outer circumferential surface of the rotor core 1221. Each of the oil return grooves 1211*b* may define an outer passage 120*c*. The inner passages 120*a* and the gap passage 120*b* may define a passage through which refrigerant discharged from the compression part C moves to the upper space S2, and the outer passages 120*c* may define a first oil return passage Po1 through which oil separated in the upper space S2 is returned to the oil storage space S11.

The stator coil 1212 may be wound around the stator core 1211 and may be electrically connected to an external power source through a power cable 1141 that is coupled through the casing 110. An insulator 1213, which is an insulating member, may be inserted between the stator core 1211 and the stator coil 1212.

The insulator 1213 may be provided at an outer circumferential side and an inner circumferential side of the stator coil 1212 to accommodate a bundle of the stator coil 1212 in the radial direction, and may extend to both sides in the axial direction of the stator core 1211.

The rotor 122 may include a rotor core 1221 and permanent magnets 1222.

The rotor core 1221 may be formed in a cylindrical shape to be accommodated in the rotor accommodating portion 1211*a* defined in the central portion of the stator core 1211.

Specifically, the rotor core 1221 may be rotatably inserted into the rotor accommodating portion 1211*a* of the stator core 1211 with a predetermined gap therebetween. The permanent magnets 1222 may be embedded in the rotor core 1221 at preset intervals along the circumferential direction.

A balance weight 123 may be coupled to a lower end of the rotor core 1221. Alternatively, the balance weight 123 may be coupled to the rotating shaft. This implementation will be described based on an example in which the balance weight 123 is coupled to the rotating shaft 125. The balance weight 123 may be disposed on each of a lower end side and an upper end side of the rotor, and the two balance weights 123 may be installed symmetrically to each other.

The rotating shaft 125 may be coupled to the center of the stator core 1211. An upper end portion of the rotating shaft 125 may be press-fitted to the rotor 122, and a lower end portion of the rotating shaft 125 may be rotatably inserted into the main frame 130 to be supported in the radial direction.

The main frame 130 may be provided with a main bearing 171 configured as a bush bearing to support the lower end portion of the rotating shaft 125. Accordingly, a portion, which is inserted into the main frame 130, of the lower end portion of the rotating shaft 125 may smoothly rotate inside the main frame 130.

The rotating shaft 125 may transfer a rotational force of the driving motor 120 to an orbiting scroll 150 constituting the compression part C. Accordingly, the orbiting scroll 150 eccentrically coupled to the rotating shaft 125 may perform an orbiting motion with respect to the fixed scroll 140.

An oil supply passage 126 having a hollow shape is provided in the rotating shaft 125, and an oil pickup 127 configured to pump oil filled in the oil storage space S11 may be coupled to a lower end of the rotating shaft 125. Accordingly, during rotation of the rotating shaft 125, the oil filled in the oil storage space S11 is sucked into an upper end of the rotating shaft 125 through the oil pickup 127 and the oil supply passage 126 to lubricate a sliding unit.

Then, the compression unit C is described.

Referring to FIG. 1, the compression unit C according to this implementation includes the main frame 130, the fixed scroll 140, and the orbiting scroll 150.

The main frame 130 may include a frame end plate 131, a frame side wall 132, and a main bearing portion 133.

The frame end plate 131 may be formed in an annular shape and installed below the driving motor 120. The frame side wall 132 may extend in a cylindrical shape from an edge of a lower surface of the frame end plate 131, and an outer circumferential surface of the frame side wall 132 may be fixed to the inner circumferential surface of the cylindrical shell 111 in a shrink-fitting or welding manner. Accordingly, the oil storage space S11 and the outflow space S12 constituting the lower space S1 of the casing 110 may be separated from each other by the frame end plate 131 and the frame side wall 132.

A frame outflow hole (hereinafter, a second outflow hole) 1321 forming a part of an outflow passage may be formed through the frame side wall 132 in the axial direction. The second outflow hole 1321 may be formed to correspond to a scroll outflow hole (first outflow hole) 1422 of the fixed scroll 140 to be described later, to define a refrigerant outflow passage (no reference numeral given) together with the first outflow hole 1422.

The second outflow hole 1321 may be elongated in the circumferential direction, or may be provided in plurality disposed at preset distances along the circumferential direction. Accordingly, the second outflow hole 1321 can secure a volume of a compression chamber relative to the same diameter of the main frame 130 by maintaining a minimum radial width with securing an outflow area. This may equally be applied to the first outflow hole 1422 that is formed in the fixed scroll 140 to define a part of the outflow passage.

The main bearing portion 133 may protrude upward from an upper surface of a central portion of the frame end plate 131 toward the driving motor 120. The main bearing portion 133 may be provided with a main bearing hole 1331 formed therethrough in a cylindrical shape along the axial direction. The first bearing portion 1252 of the rotating shaft 125 may be inserted into the main bearing hole 1331 to be supported in the radial direction.

Hereinafter, the fixed scroll will be described.

Referring to FIG. 1, the fixed scroll 140 according to the implementation may include a fixed end plate 141, a fixed side wall 142, a sub bearing portion 143, and a fixed wrap 144.

The fixed end plate 141 may be formed in a disk shape having a plurality of concave portions on an outer circumferential surface thereof, and a sub bearing hole 1431 defining the sub bearing portion 143 to be described later may be formed through a center of the fixed end plate 141 in the vertical direction. Discharge ports 1411 and 1412 may be formed around the sub bearing hole 1431. The discharge ports 1411 and 1412 may communicate with a discharge pressure chamber Vd so that compressed refrigerant is moved into the muffler space 160*a* of the discharge cover 160 to be explained later.

Only one discharge port may be provided to communicate with both of a first compression chamber V1 and a second compression chamber V2 to be described later. In the implementation, however, a first discharge port (no reference numeral given) may communicate with the first compression chamber V1 and a second discharge port (no reference numeral given) may communicate with the second compression chamber V2. Accordingly, refrigerant compressed in the first compression chamber V1 and refrigerant compressed in the second compression chamber V2 may be independently discharged through the different discharge ports.

The fixed side wall 142 may extend in an annular shape from an edge of an upper surface of the fixed end plate 141 in the vertical direction. The fixed side wall 142 may be coupled to face the frame side wall 132 of the main frame 130 in the vertical direction.

The fixed side wall 142 may be provided with a suction port 1421 formed through the fixed side wall 142 in the radial direction. As aforementioned, an end portion of the refrigerant suction pipe 115 inserted through the cylindrical shell 111 may be inserted into the suction port 1421.

The suction port 1421 is provided to be inserted through an outer circumferential surface of the fixed side wall 142 into an inner circumferential surface of the fixed side wall 142. The suction port 1421 is provided such that inner diameters at both ends are identical to each other. However, in some cases, inner diameters at both the ends of the suction port 1421 may be different from each other.

The refrigerant suction pipe 115 is connected to an outer end of the suction port 1421, and an inner end of the suction port 1421 communicates with the suction pressure chamber Vs. Accordingly, refrigerant is directly sucked into the suction pressure chamber Vs through the refrigerant suction pipe 115 and the suction port 1421. The suction port 1421 will be described later together with a reinforcing unit 145.

A scroll outflow hole (hereinafter, first outflow hole) 1422 may be formed through the fixed side wall 142 in the axial direction. The first outflow hole 1422 may be elongated in the circumferential direction, or may be provided in plurality disposed at preset distances along the circumferential direction. Accordingly, the first outflow hole 1422 can secure a volume of a compression chamber relative to the same diameter of the fixed scroll 140 by maintaining a minimum radial width with securing a discharge area.

The first outflow hole 1422 may communicate with the second outflow hole 1321 in a state in which the fixed scroll 140 is coupled to the cylindrical shell 111. Accordingly, the first outflow hole 1422 can define a refrigerant outflow passage together with the second outflow hole 1321.

The sub bearing portion 143 may extend in the axial direction from a central portion of the fixed end plate 141 toward the discharge cover 160. A sub bearing hole 1431 having a cylindrical shape may be formed through a center of the sub bearing portion 143 in the axial direction, and a lower end portion of the rotating shaft 125 may be inserted into the sub bearing hole 1431 to be supported in the radial direction.

The fixed wrap 144 may extend from the upper surface of the fixed end plate 141 toward the orbiting scroll 150 in the axial direction. The fixed wrap 144 may be engaged with an orbiting wrap 152 to be described later to define the compression chamber V.

The fixing wrap 144 may be formed in an involute shape. However, the fixed wrap 144 and the orbiting wrap 152 may be formed in various shapes other than the involute shape.

For example, the fixed wrap 144 may be formed in a substantially elliptical shape in which a plurality of arcs having different diameters and origins are connected and the outermost curve may have a major axis and a minor axis. The orbiting wrap 152 may also be formed in a similar manner.

An inner end of the fixed wrap 144 may be provided in a central portion of the fixed end plate 141, and a through hole (no reference numeral) is provided to axially penetrate through the central portion of the fixed end plate 141. The through hole communicates with the sub bearing 143 described above such that the rotating shaft 125 is rotatably inserted into the through hole.

Hereinafter, the orbiting scroll will be described.

Referring to FIG. 1, the orbiting scroll 150 according to the implementation may include an orbiting end plate 151, an orbiting wrap 152, and a rotating shaft coupling portion 153.

The orbiting end plate 151 may be formed in a disk shape and accommodated in the main frame 130. An upper surface of the orbiting end plate 151 may be supported in the axial direction by the main frame 130 with interposing a back pressure sealing member (no reference numeral given) therebetween.

The orbiting wrap 152 may extend from a lower surface of the orbiting end plate 151 toward the fixed scroll 140. The orbiting wrap 152 may be engaged with the fixed wrap 144 to define the compression chamber V.

Since the orbiting wrap 152 has a shape corresponding to the shape of the fixed wrap 144 described above, a description of the orbiting wrap 152 will be replaced with the description of the fixed wrap 144. However, an inner end portion of the orbiting wrap 152 may be formed at a central portion of the orbiting end plate 151, and the rotating shaft coupling portion 153 may be formed through the central portion of the orbiting end plate 151 in the axial direction.

The rotating shaft 125 may be rotatably inserted and coupled into the rotating shaft coupling portion 153. An outer circumferential part of the rotating shaft coupling portion 153 may be connected to the orbiting wrap 152 to define the compression chamber V together with the fixed wrap 144 during a compression process.

The rotating shaft coupling portion 153 may be formed at a height at which it overlaps the orbiting wrap 152 on the same plane. That is, the rotating shaft coupling portion 153 may be disposed at a height at which the eccentric portion (no reference numeral) of the rotating shaft 125 overlaps the orbiting wrap 152 on the same plane. Accordingly, repulsive force and compressive force of refrigerant can cancel each other while being applied to the same plane based on the orbiting end plate 151, and thus inclination of the orbiting scroll 150 due to interaction between the compressive force and the repulsive force can be suppressed.

On the other hand, the compression chamber V may be formed in a space defined by the fixed end plate 141, the fixed wrap 144, the orbiting end plate 151, and the orbiting wrap 152. The compression chamber V may include a first compression chamber V1 defined between an inner surface of the fixed wrap 144 and an outer surface of the orbiting wrap 152, and a second compression chamber V2 defined between an outer surface of the fixed wrap 144 and an inner surface of the orbiting wrap 152.

In the drawings, reference numeral 160 denotes a discharge cover that guides refrigerant discharged from the compression chamber to the upper space, 160*a* denotes a muffler space as an inner space of the discharge cover, 170 denotes an Oldham ring, and 180 denotes a flow path guide for separating discharged refrigerant and returned oil from each other.

The scroll compressor according to the implementation of the present disclosure may operate as follows.

That is, when power is applied to the motor part 120, rotational force may be generated and the rotor 122 and the rotating shaft 125 may rotate accordingly. As the rotating shaft 125 rotates, the orbiting scroll 150 eccentrically coupled to the rotating shaft 125 may perform an orbiting motion relative to the fixed scroll 140 by the Oldham ring 170.

Accordingly, the volume of the compression chamber V may decrease gradually along a suction pressure chamber Vs defined at an outer side of the compression chamber V, an intermediate pressure chamber Vm continuously formed toward a center, and a discharge pressure chamber Vd defined in a central portion.

Then, refrigerant which has passed through the condenser, an expander, and an evaporator of a refrigeration cycle device, may be suctioned toward the suction pressure chamber Vs defining the compression chamber V through an accumulator and the refrigerant suction pipe 115.

The refrigerant suctioned into the suction pressure chamber Vs may be compressed while moving to the discharge pressure chamber Vd via the intermediate pressure chamber Vm along a movement trajectory of the compression chamber V. The compressed refrigerant may be discharged from the discharge pressure chamber Vd to the muffler space 160*a* of the discharge cover 60 through the discharge ports 1411 and 1412.

Then, the refrigerant (refrigerant is oil-mixed refrigerant but in description, mixed refrigerant or refrigerant will all be used) that has been discharged to the muffler space 160*a* of the discharge cover 160 may move to the outflow space S12 defined between the main frame 130 and the driving motor 120 through the muffler space 160*a* of the discharge cover 160 and the first outflow hole 1422 of the fixed scroll 140. The mixed refrigerant may pass through the driving motor 120 to move to the upper space S2 of the casing 110 defined above the driving motor 120.

The mixed refrigerant moved to the upper space S2 is separated into refrigerant and oil in the upper space S2. The refrigerant (or some mixed refrigerant from which oil is not separated) may flow out of the casing 110 through the refrigerant discharge pipe 116 so as to move sequentially through a condenser, an expander, and an evaporator, which constitutes a refrigeration cycle, along the refrigerant pipe.

On the other hand, the oil separated from the refrigerant in the upper space S2 (or mixed oil with liquid refrigerant) may move to the lower space S1 along the first oil return passage Po1 between the inner circumferential surface of the casing 110 and the stator 121. The oil moved to the lower space S1 may be returned to the oil storage space S11 defined in the lower portion of the compression part C along the second oil return passage Po2 between the inner circumferential surface of the casing 110 and the outer circumferential surface of the compression part C.

This oil may thusly be supplied to each bearing surface through the oil supply passage 126, and partially supplied into the compression chamber V. Oil supplied to bearing surfaces and the compression chamber V may be discharged to the discharge cover 160 together with refrigerant and then returned. This series of processes may be repeatedly performed.

As described above, a fixed scroll connected to a refrigerant suction pipe may be damaged by head deflection generated during operation of the compressor. Particularly, since a fixed wrap is provided such that a wrap thickness is small at a suction end located at an edge than at a discharge end located in a central portion, the fixed wrap may be vulnerable to lateral load.

In addition, when the suction end of the fixed wrap is provided to have a great length to ensure suction volume, the suction end of the fixed wrap may be easily damaged in a case of thermal deformation of the fixed scroll as described above and a suction pressure chamber is elongated in a direction from a center of a suction port to be apart from the discharge port. Thus, as vortex is generated, a suction loss may increase.

Accordingly, in this implementation, a length of a fixed wrap may be reduced so that a suction end of the fixed wrap overlaps a suction port. Thus, rigidity of the fixed wrap may be ensured and a damage to the fixed wrap may be suppressed. In addition, elongation in a direction opposite to a direction that refrigerant is suctioned may be minimized, and thus, vortex in a suction pressure chamber may be suppressed to minimize a suction loss.

Hereinafter, for description, the suction end of the fixed wrap is defined as an end of the fixed wrap, that is, a circular arc surface facing a suction end of an orbiting wrap when a fixed scroll and an orbiting scroll are assembled to be aligned. Accordingly, an outlet end of the suction port may be understood as a same surface as a side surface of the suction pressure chamber extending from the circular arc surface to outside.

Figure 3:
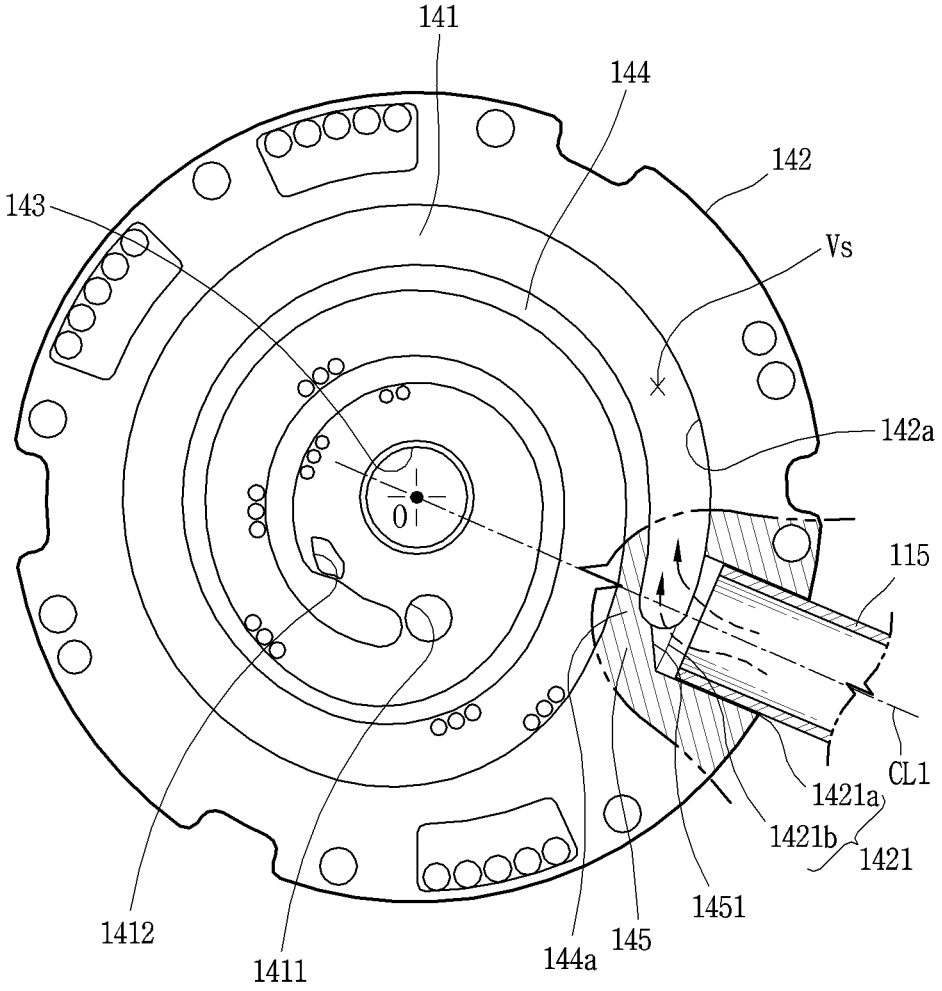
FIG. 3 is a bottom view of the fixed scroll of FIG. 2.
Figure 4:
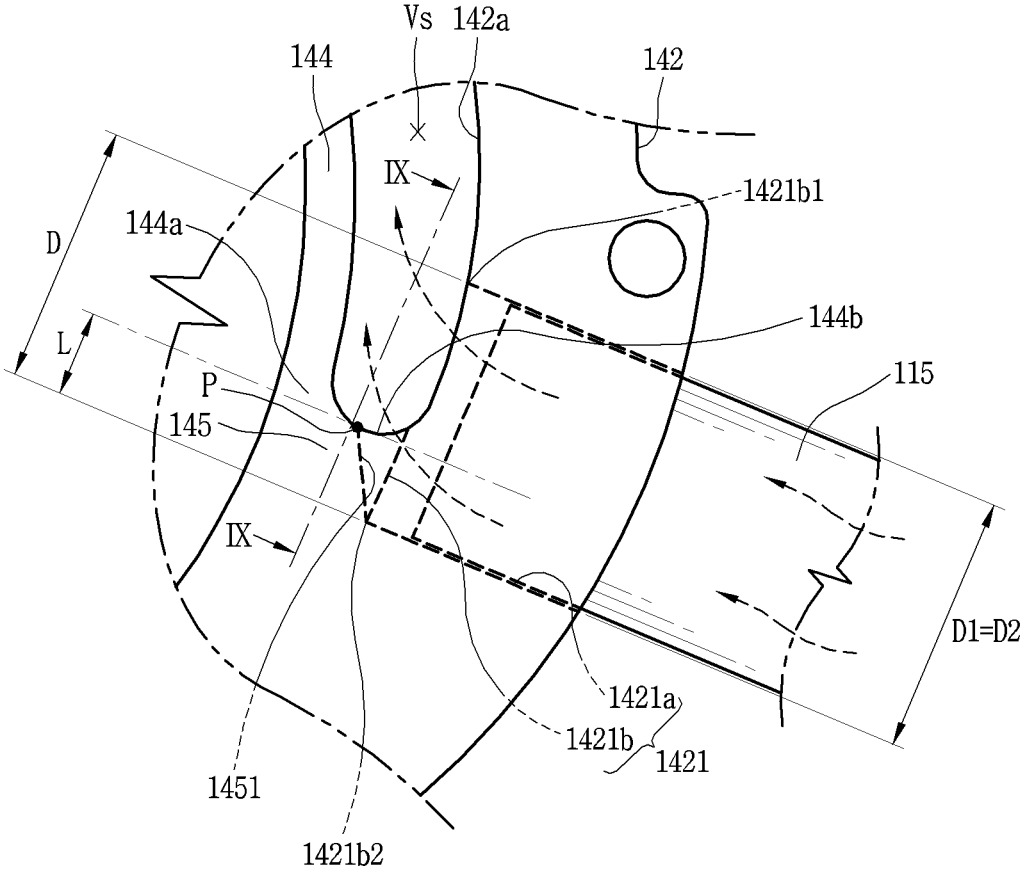
FIG. 4 is an enlarged bottom view of one implementation of a reinforcing unit of FIG. 3.
Figure 5:
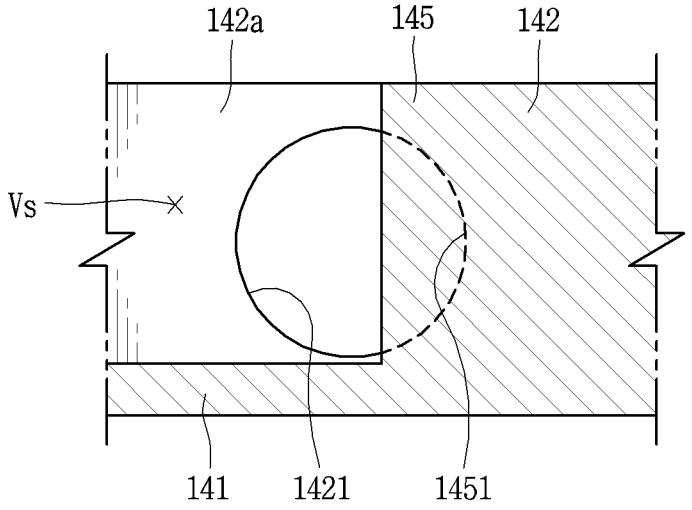
FIG. 5 is a cross-sectional view of the reinforcing unit taken along line "IX-IX" of FIG. 4.

FIG. 2 is a detached perspective view of a fixed scroll and an orbiting scroll both shown in FIG. 1. FIG. 3 is a bottom view of the fixed scroll of FIG. 2. FIG. 4 is an enlarged bottom view of one implementation of a reinforcing unit of FIG. 3. FIG. 5 is a cross-sectional view taken along line "IX-IX" of FIG. 4.

Referring to FIGS. 2 to 5, the scroll compressor according to this implementation includes the fixed scroll 140 fixed to an inner circumferential surface of the casing 110. As described above with respect to the compression unit C, the fixed scroll 140 includes the fixed end plate 141, the fixed side wall 142, the sub bearing 143, and the fixed wrap 144. Among the fixed end plate 141, the fixed side wall 142, the sub bearing 143, and the fixed wrap 144, the suction port 1421 is provided in the fixed side wall 142, and the reinforcing unit 145 configured to reinforce rigidity of the fixed wrap 144 is provided between the fixed side wall 142 and the fixed wrap 144.

In detail, the suction port 1421 according to this implementation includes an inlet end 1421*a* and an outlet end 1421*b*. The inlet end 1421*a* may be provided to penetrate through an outer circumferential surface of the fixed side wall 142, and the outlet end 1421*b* may be provided to penetrate through an inner circumferential surface of the fixed side wall 142. The refrigerant suction pipe 115 may be connected into the inlet end 1421*a* of the suction end 1421. The outlet end 1421*b* of the suction port 1421 may penetrate through the inner circumferential surface of the fixed side wall 142 to communicate with the suction pressure chamber Vs. Accordingly, the inner circumferential surface of the fixed side wall 142 may be understood as a suction pressure chamber side surface 142*a*. In other words, the inner circumferential surface of the fixed side wall 142 or the suction pressure chamber side surface 142*a* may be understood as a surface extending from the suction end 144*a* of the fixed wrap 144 to outside, on the contrary to the outer circumferential surface of the fixed wrap 144 extending from the suction end 144*a* of the fixed wrap 144 to inside.

The suction port 1421 may be provided to have a cylindrical shape in which an inner diameter D1 of the inlet end 1421*a* is nearly identical to an inner diameter D2 of the outlet end 1421*b*. However, the suction port 1421 may not necessarily have a cylindrical shape such that inner diameters of the inlet end 1421*a* and the outlet end 1421*b* of the suction port 1421 are identical to each other. For example, the suction port 1421 may be provided such that the inner diameter D1 of the inlet end 1421*a* is longer than the inner diameter D2 of the outlet end 1421*b*, or vice versa.

The suction port 1421 may be penetrated in a radial direction. For example, the suction port 1421 may be radially provided such that a first center line CL1 passing through a center of the inlet end 1421 and a center of the outlet end 1421 passes through an axial center O of the rotating shaft 125. Accordingly, a length of the suction inlet 1421 may be reduced, and machining may be facilitated.

The reinforcing unit 145 according to this implementation is provided between the suction port 1421 and the fixed wrap 144, that is, the outlet end 1421*b* of the suction port 1421 and the suction end 144*a* of the fixed wrap 144 facing the outlet end 1421*b*. Accordingly, the reinforcing unit 145 connects the outlet end 1421*b* of the suction end 1421 to the suction end 144*a* of the fixed wrap 144 facing the outlet end 1421*b*.

In other words, when being axially projected, the reinforcing unit 145 may be provided to radially overlap a part of the outlet end 1421*b* of the suction end 1421. Accordingly, when being axially projected, the reinforcing unit 145 may be arranged between the outlet end 1421*b* of the suction port 1421 and the outer circumferential surface of the fixed wrap 144 to be circumferentially in parallel with the outlet end 1421*b* of the suction port 1421.

In detail, the reinforcing unit 145 is provided to radially overlap the suction port 1421, and may extend along a circumference of the outlet end 1421*b* of the suction port 1421 from a downstream end 1421*b*2 of the outlet end 1421*b* toward an upstream end 1421*b*1 of the outlet end 1421 at an opposite side, the downstream end 1421*b*2 of the outlet end 1421*b* being an end spaced far apart from the discharge ports 1411 and 1412 along a wrap providing direction of the fixed wrap 144, i.e., a same direction as that of providing the compression chamber V. In other words, the reinforcing unit 145 is provided to be located at an opposite side of the discharge ports 1411 and 1412 with reference to the first center line CL1. Accordingly, the reinforcing unit 145 may be provided between the outlet end 1421*b* of the suction port 1421 and the outer circumferential surface of the fixed wrap 144, and meanwhile, refrigerant passing through the suction port 1421 may be smoothly sucked along the compression chamber V having a helical form toward a center portion (a discharge port).

The reinforcing unit 145 described above may be defined by a circular arc surface 144*b*. That is, the reinforcing unit 145 may be provided such that an inflection point P of the circular arc surface 144*b* is located within a range of a circumferential direction of the suction port 1421, the inflection point P connecting the suction end 144*a* of the fixed wrap 144 to the suction pressure chamber side surface 142*a*, i.e., the inner circumferential surface of the fixed side wall 142. Thus, it is understood that, when the fixed scroll 140 is viewed in an axial direction, the circular arc surface 144*b* constituting the reinforcing unit 145 overlaps a part of the suction port 1421 to block the part of the suction port 1421.

In this case, the inflection point P may be provided at a portion far apart from the discharge ports 1411 and 1412 with reference to the first center line CL1. For example, the inflection point P may be provided in a position such that an overlapping length L is less than an inner diameter D of the suction port 1421, the overlapping length L being a length from a circumferential end of the circular arc surface 144*b*, constituting an end of the reinforcing unit 145, to the downstream 144*b*2 of the suction port 1421 located at the portion far apart from the discharge ports 1411 and 1412. Accordingly, rigidity of the reinforcing unit 145 may be reinforced, and an excessive increase in suction loss may be suppressed. This will be explained later with reference to FIG. 6.

A suction guide groove 1451 may be provided in a surface of the reinforcing unit 145 facing the suction port 1421. The suction guide groove 1251 may be provided to be inclined from the outlet end 1421*b* of the suction port 1421 toward the outer circumferential surface of the fixed wrap 144.

In detail, the suction guide groove 1451 may be provided to be inclined in a direction from the farthest end 1421*b*2 of the outlet end 1421*b* of the suction port 1421 (the downstream end of the suction port) apart from the discharge ports 1411 and 1412, with reference to the wrap providing direction of the fixed wrap 144 (or a direction of providing a compress chamber), toward the fixed wrap 144 to be close to the discharge ports 1411 and 1412. Accordingly, even when the reinforcing unit 145 overlaps the outlet end 1421*b* of the suction port 1421 in a certain section, the discharge end 1421*b* of the suction port 1421 may have a fully open shape at the suction pressure chamber side surface 142*a*. Thus, a suction loss due to the reinforcing unit 145 may be minimized.

The suction guide groove 1451 may be provided to be inclined to have a plane shape or a conical shape (accurately, a semi-conical shape). In this implementation, an example in which the suction guide groove 1451 is inclined to have a conical shape progressively narrowing from the outlet end 1421*b* of the suction port 1421 toward the fixed wrap 144 is illustrated. Accordingly, the suction port 1421 and the suction guide groove 1451 may be easily machined using drill machining.

As described above, when the reinforcing unit 145 is arranged between the outlet end 1421*b* of the suction port 1421 and the outer circumferential surface of the fixed wrap 144 facing the outlet end 1421*b*, an effect such as a reduction in a length of the suction end 144*a* of the fixed wrap 144 or an increase in thickness thereof may occur. Thus, rigidity of the fixed wrap 144 may be increased in correspondence thereto. Accordingly, when the compressor operates, even when the fixed scroll 140 is heat deflected, deformation of the fixed wrap 144 is suppressed to minimum. Thus, reliability may be enhanced.

In addition, since a length of an end portion of the suction end 144*a* of the fixed wrap 144 is reduced, refrigerant passing through the suction end 1421 may be obstructed from flowing toward an opposite direction of the discharge ports 1411 and 1412. Thus, vortex in the suction pressure chamber Vs may be suppressed, and suction loss due to the vortex may be reduced. Therefore, rigidity of the fixed wrap 144 may be reinforced, and meanwhile, the suction loss may be reduced.

The reinforcing unit 145 may be provided such that the overlapping length L with the suction port 1421 (hereinafter, an overlapping length of the reinforcing unit or an overlapping length of a wrap end) is about 50% of the inner diameter D of the outlet end of the suction port 1421 or less (for convenience of description, defined as an inner diameter of the suction port). In other words, the overlapping length L of the reinforcing unit 145 with the suction port 1421 (accurately, an outlet end of the suction port), from the downstream 1421*b*2 of the suction port 1421 to the upstream 1421*b*1 of the suction port 1421 facing the downstream 1421*b*2, may be about a half or less the inner diameter D of the suction port 1421. Accordingly, the reinforcing unit 145 may reinforce rigidity of the fixed wrap 144, and suction loss due to the reinforcing unit 145 may be reduced.

Figure 6:
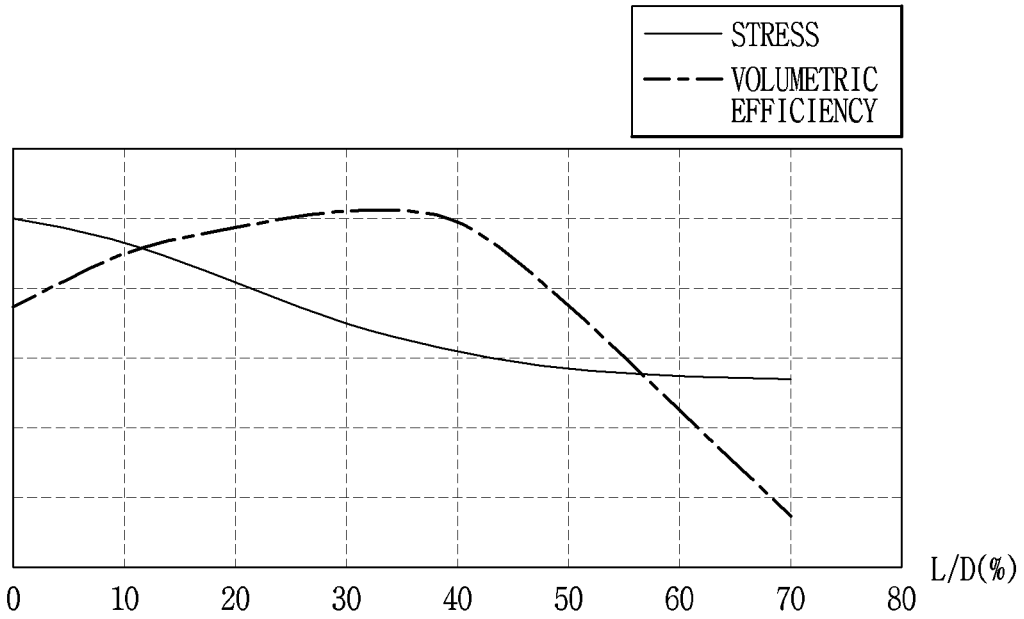
FIG. 6 is a graph illustrating comparison of stress on a fixed wrap with volumetric efficiency of a compression chamber, with respect to the reinforcing unit in this implementation.

This may be explained with reference to FIG. 6. FIG. 6 is a graph illustrating a comparison of stress on a fixed wrap with volumetric efficiency of a compression chamber, with respect to a reinforcing unit in this implementation. This shows a comparison of a stress on the fixed wrap with volumetric efficiency of the compression chamber, with respect to a value obtained by dividing the overlapping length L of the reinforcing unit 145 by the inner diameter D of the suction port 1421.

As illustrated in FIG. 6, stress on the fixed wrap 144 according to this implementation gently decreases when the stress passes about 50%, and the volumetric efficiency at the suction port 1421 greatly decreases when approximating to 40%. Thus, it may be understood that, when the overlapping L of the reinforcing unit 145 (or an overlapping length at a wrap end) is set to 50% of the inner diameter D of the suction port 1421 or more, deterioration of the volumetric efficiency excessively increases compared to an effect of reinforcing rigidity. Accordingly, the overlapping length L of the reinforcing unit 145 may be desirably provided to be about 50% of the inner diameter D of the suction port 1421 or less.

Hereinafter, a description will be given of another implementation of a reinforcing unit.

That is, in the implementations described above, a suction guide groove is inclinedly provided in a reinforcing unit. However, in some cases, the suction guide groove may be provided to be radially recessed.

Figure 7:
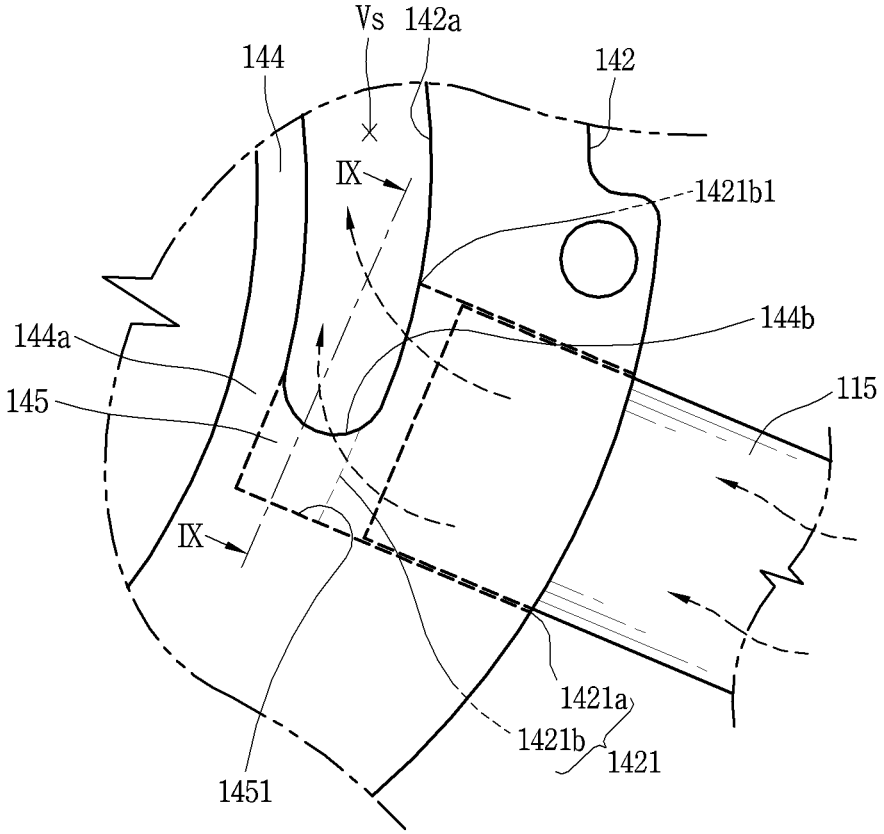
FIG. 7 is an enlarged bottom view of another implementation of the reinforcing unit of FIG. 3.
Figure 8:
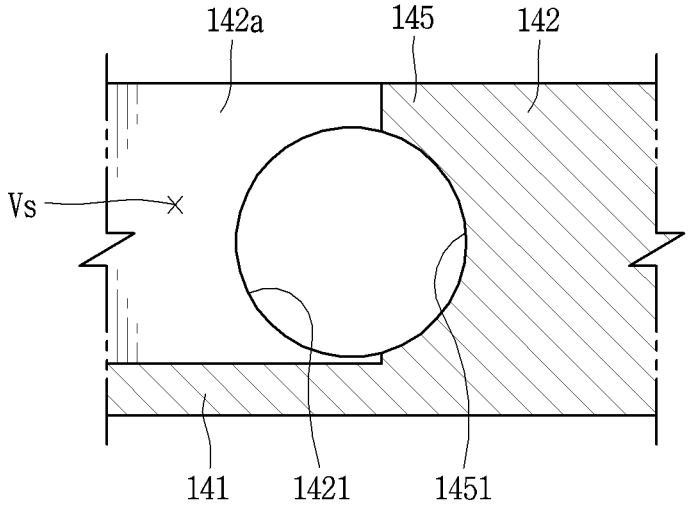
FIG. 8 is a cross-sectional view of the reinforcing unit taken along line "X-X" of FIG. 7.

FIG. 7 is an enlarged bottom view of another implementation of the reinforcing unit of FIG. 3. FIG. 8 is a cross-sectional view taken along line "X-X" of FIG. 7, Referring to FIGS. 7 and 8, the fixed scroll 140 according to this implementation may be provided nearly identically to the fixed scroll in the above-described implementation. For example, the fixed scroll 140 according to this implementation includes the fixed end plate 141, the fixed side wall 142, the sub bearing 143, and the fixed wrap 144, like the above-described implementation. The suction port 1421 may be radially provided in the fixed side wall 142, and the reinforcing unit 145 may be provided between the outlet end 1421*b* of the suction port 1421 and an outer circumferential surface of the fixed wrap 144 facing the outlet end 1421*b*. A basic configuration and an effect of the fixed end plate 141, the fixed side wall 142, the sub bearing 143, the fixed wrap 144, and the reinforcing unit 145 are identical to those of the implementation described above. Thus, with respect to a description thereof, the description about the above-described implementation may be referred to.

However, the suction guide groove 1451 may be provided in the reinforcing unit 145 according to this implementation, and have a cylindrical shape. For example, the suction guide groove 1451 may be provided to be radially recessed, and have a cylindrical shape (accurately, a semi-cylindrical shape) with a same inner diameter as that of the suction port 1421. Accordingly, the suction guide groove 1451 may be provided to have a rectangular shape in which a radial side surface 1451*a* constitutes approximately a plane.

In this case, a portion of the reinforcing unit 145 other than the suction guide groove 1451 connects the suction pressure chamber side surface 142*a*, constituting the outlet end 1421*b* of the suction port 1421 to the outer circumferential surface of the fixed wrap 144. Thus, a length of the fixed wrap 144 may be reduced or a thickness of the fixed wrap 144 may be increased. Accordingly, since rigidity of the suction end 144*a* of the fixed wrap 144 is increased, even when the fixed scroll 140 is heat-deflected, deformation of the suction end 144*a* of the fixed wrap 144 may be suppressed or minimized.

Also, as the suction guide groove 1451 is radially recessed in the reinforcing unit 145, the outlet end 1421*b* of the substantial suction port 1421 extends to the radial side surface 1451*a* of the suction guide groove 1451. Thus, the reinforcing unit 145 may be provided to overlap the outlet end 1421*b* of the suction port 1421, and meanwhile, a large suction port area may be also ensured. Therefore, reduction in volumetric efficiency may be suppressed.

The reinforcing unit 145 may be provided to extend directly from the outlet end 1421*b* of the suction port 1421. In other words, the reinforcing unit 145 may be provided to have a same cross-sectional area in a radial direction other than the suction guide groove 1451. In this case, an area of the reinforcing unit 145 increases in correspondence thereto, and thus, rigidity of the fixed wrap 144 may be increased. However, in this case, since the suction guide groove 1451 is not included, the reinforcing unit 145 blocks a part of the suction port 1421. Thus, an overlapping distance of the reinforcing unit 145 may be adjusted to prevent excessive occurrence of suction loss.

Hereinafter, a description will be given of another implementation of a suction port.

That is, in the above-described implementation, a suction port is provided in a radial direction. However, in some cases, a suction port may be provided in a direction crossing the radial direction.

Figure 9:
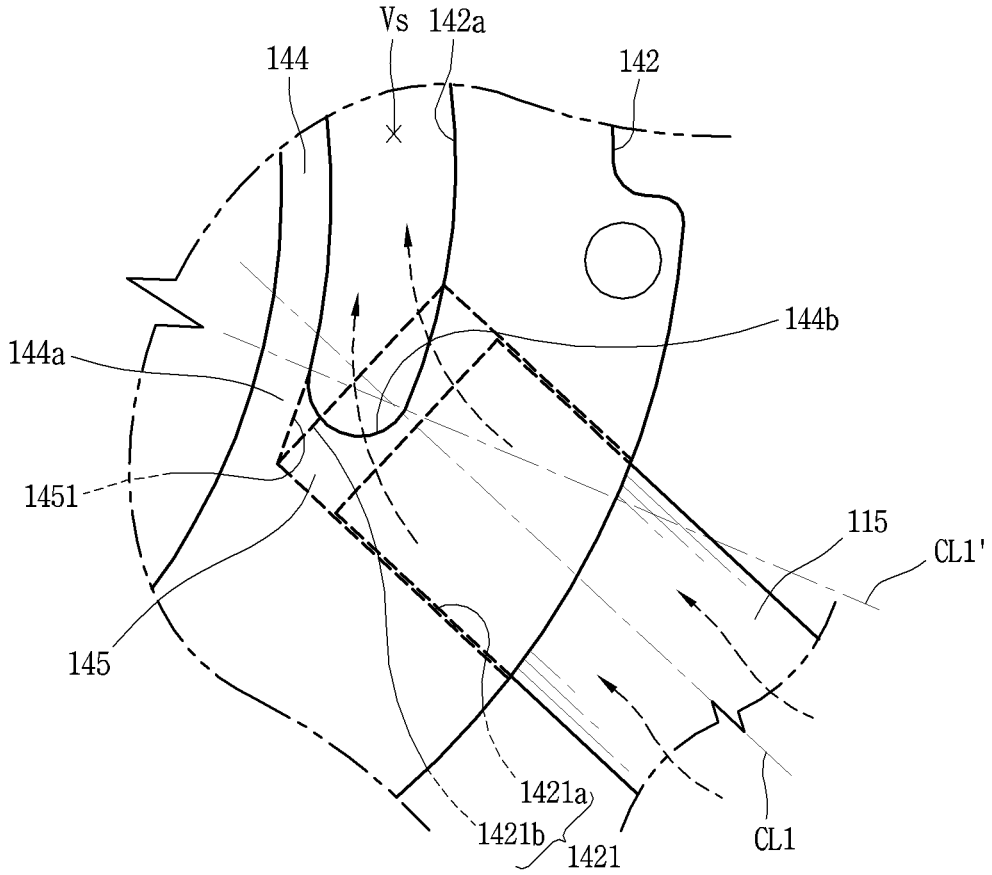
FIG. 9 is an enlarged view illustrating another implementation with respect to a suction port of this implementation.

FIG. 9 is an enlarged view illustrating another implementation with respect to a suction port of this implementation.

Referring to FIG. 9, the suction port 1421 according to this implementation includes the inlet end 1421*a* and the outlet end 1421*b*. Like the implementation described above with reference to FIG. 4, the inlet end 1421*a* may be provided to be inserted through an outer circumferential surface of the fixed side wall 142, and the outlet end 1421*b* may be provided to be inserted through an inner circumferential surface of the fixed side wall 142. A basic shape and an effect of the suction port are identical to those in the above-described implementation. Thus, with respect to a description thereof, the description about the above-described implementation may be referred to.

However, the suction port 1421 according to this implementation is provided in a direction crossing a radial direction. In other words, the suction port 1421 is inclinedly provided such that the first center line CL1 passing through a center of the inlet end 1421*a* and a center of the outlet end 1421*b* crosses a radial center line CL1' radially passing through the axial center O of the rotating shaft 125. For example, the suction port 1421 may be inclinedly provided in a direction in which the outlet end 1421*b* is close to the discharge ports 1411 and 1412, i.e., a direction in which the outlet end 1421*b* is far apart from the suction end 144*a* of the fixed wrap 144. Accordingly, since oil flow resistance at the suction port 1421 is reduced, suction refrigerant may be quickly and smoothly sucked.

In this implementation, the reinforcing unit 145 described above may be provided between the outlet end 1421*b* of the suction port 1421 and the outer circumferential surface of the fixed wrap 144 facing the outlet end 1421*b*. and the suction guide groove 1451 described above may be provided in the reinforcing unit 145. In regard to a description of the reinforcing unit 145 and the suction guide groove 1451, the description about the above-described implementations may be referred to.

Hereinafter, a description will be given of still another implementation of the suction port.

That is, in the above-described implementation, both ends of a suction port are provided to include a same inner diameter. However, in some cases, both ends of the suction port may have different inner diameters.

Figure 10:
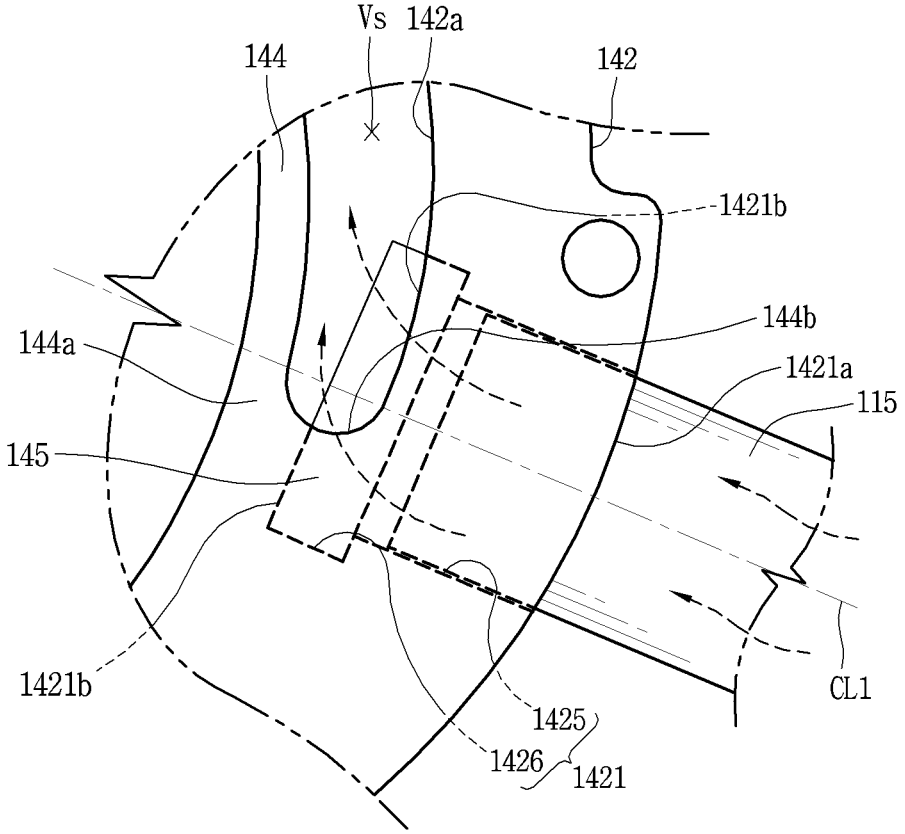
FIG. 10 is an enlarged view illustrating still another implementation with respect to the suction port of this implementation.

FIG. 10 is an enlarged view illustrating still another implementation with respect to a suction port of this implementation.

Referring to FIG. 10, the suction port 1421 according to this implementation includes the inlet end 1421*a* and the outlet end 1421*b*. Like the implementation described above with reference to FIG. 4, the inlet end 1421*a* may be inserted through an outer circumferential surface of the fixed side wall 142, and the outlet end 1421*b* may be inserted through an inner circumferential surface of the fixed side wall 142. A basic shape and an effect of the suction port 1421 are identical to those in the above-described implementation. Thus, in regards to a description thereof, the description about the above-described implementation may be referred to.

However, the suction port 1421 according to this implementation may be provided such that an inner diameter of the inlet end 1421*a* is greater than an inner diameter of the outlet end 1421*b*. For example, the suction port 1421 may include a first suction unit 1425 and a second suction unit 1426. The first suction unit 1425 corresponds to a portion from the inlet end 1421*a* of the suction port 1421 to an arbitrary point in a radial direction, and the second suction unit 1426 corresponds to a portion from the arbitrary point to the outlet end 1421*b*.

A center of the first suction unit 1425 may be located on a same center line as that of the second suction unit 1426. Accordingly, the suction unit 1421 may be provided to have a multi-stage shape having two (or more) inner diameters, and the suction port 1421 may be also easily machined.

When an inner diameter of the first suction unit 1425 is a first diameter D1 and an inner diameter of the second suction unit 1426 is a second diameter D2, the second diameter D2 may be provided to be greater than the first diameter D1. Thus, a cross-sectional area of the suction port 1421 may increase at the outlet end 1421*b*.

In this case, the outlet end 1421*b* of the suction port 1421, in other words, the suction end 144*a* of the fixed wrap 144 may be provided such that the reinforcing unit 145 radially overlaps the suction port 1421. Since the reinforcing unit 145 are identical to that in the above-described implementations, a detailed description thereof is not provided here.

However, in this implementation, the second suction unit 1426 constituting the outlet end 1421*b* of the suction port 1421 is provided in the reinforcing unit 145 to have an approximate cylindrical shape (accurately, an approximate semi-cylindrical shape). Thus. the reinforcing unit 145 is provided between the outlet end 1421*b* of the suction port 1421 and the fixed wrap 144, and occurrence of oil flow resistance due to the reinforcing unit 145 may be also suppressed or reduced. Therefore, volumetric efficiency may be enhanced.

The first and second suction units 1425 and 1426 may be provided to be located on different center lines. For example, the suction port 1421 may be provided eccentrically to the discharge ports 1411 and 1412 compared to the first suction unit 1425. By doing so, a substantial suction port area of the suction port 1421 may be enlarged, and a rear side area of the outlet end 1421*b* of the suction port 1421 may be also reduced. Thus, the suction port area of the suction port 1421 may be enlarged, and meanwhile, occurrence of vortex near the outlet end 1421*b* of the suction port 1421 may be suppressed.

Hereinafter, a description will be given of still another implementation of the suction port.

That is, in the above-described implementations, the suction port is always open. However, in some cases, a check valve may be installed at the suction port, and reverse rotation of an orbiting scroll during a stop of the compressor may be suppressed, and refrigerant or oil may be suppressed from flowing back.

Figure 11:
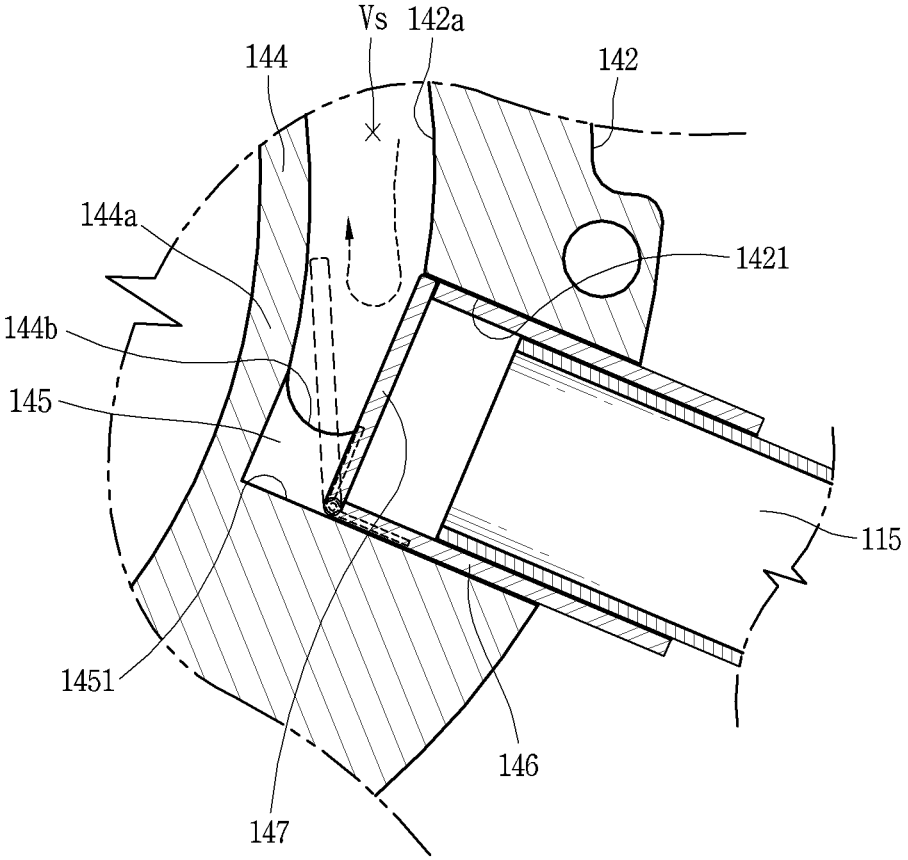
FIG. 11 is a cross-sectional view illustrating one implementation of a suction valve included in the suction port of this implementation.

FIG. 11 is a cross-sectional view illustrating one implementation of a suction valve included in a suction port in this implementation.

Referring to FIG. 11, the suction port 1421 according to this implementation includes the inlet end 1421*a* and the outlet end 1421*b*. Like the above-described implementations of FIGS. 4 and 7, the inlet end 1421*a* may be provided to be inserted through an outer circumferential surface of the fixed side wall 142, and the outlet end 1421*b* may be provided to be inserted through an inner circumferential surface of the fixed side wall 142. A basic shape and an effect of the suction port 1421 are identical to those in the above-described implementation. Thus, in regard to a description thereof, the description about the above-described implementation may be referred to.

However, in this implementation, a valve pipe 146 having a hollow shape with both ends being open may be inserted into the suction port 1421, and include a suction valve 147 configured to selectively open or close the suction port 1421 by opening or closing the valve pipe 146. For example, the suction valve 147 may be hinged to an end of the valve pipe 146 adjacent to the outlet end 1421*b* of the suction port 1421. Thus, when the compressor stops, the suction valve 147 closes the end of the valve pipe 146 due to a pressure difference to block a suction flow. Accordingly, the orbiting wrap 152 or the fixed wrap engaged therewith may be suppressed from being damaged due to reverse rotation of the orbiting scroll 150, and refrigerant and oil in the discharge pressure chamber Vd or the intermediate pressure chamber Vm may be suppressed from flowing back to the suction pressure chamber Vs and thus being spilled into the refrigerant suction pipe 115.

In addition, in this case, the outlet end 1421*b* of the suction port 1421, in other words, the suction end 144*a* of the fixed wrap 144 may be provided such that the reinforcing unit 145 radially overlaps the suction port 1421. Since the reinforcing unit 145 are identical to that in the above-described implementations, a detailed description thereof is not provided here.

In addition, in this case, a suction guide groove 1452 may be provided in the reinforcing unit 145. Like the implementation described above with reference to FIG. 7, the suction guide groove 1452 may be elongated in a radial direction (or a direction toward the fixed wrap 144), and a cross-sectional area of the suction guide groove 1452 may be provided to be larger than that of the suction valve 147 to accommodate the suction valve 147. Thus, the suction valve 147 hinged to the valve pipe 146 may rotate at an end of the valve pipe 146 toward the suction guide groove 1452 to smoothly open or close the end of the valve pipe 146, i.e., the suction port 1421.

Hereinafter, a description will be given of another implementation of a suction valve.

That is, in the above-described implementation, a hinge-type suction valve is provided at a suction port. However, in some cases, a piston-type valve may be installed at a suction port.

Figure 12:
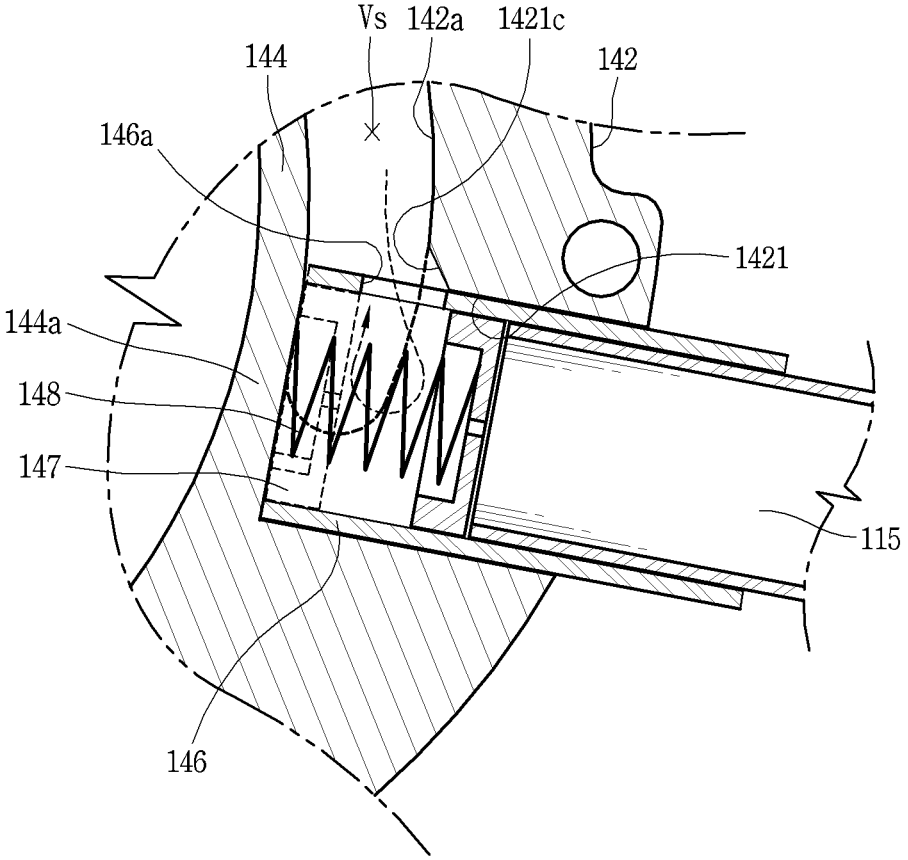
FIG. 12 is a cross-sectional view illustrating another implementation with respect to the suction valve included in the suction port of this implementation.

FIG. 12 is a cross-sectional view illustrating another implementation with respect to a suction valve included in a suction port of this implementation.

Referring to FIG. 12, the suction port 1421 according to this implementation includes the inlet end 1421*a* and the outlet end 1421*b*. Like the implementations described with reference to FIGS. 4 and 7, the inlet end 1421*a* may be provided to be inserted through an outer circumferential surface of the fixed side wall 142, and the outlet end 1421*b* may be provided to be inserted through an inner circumferential surface of the fixed side wall 142. A basic shape and an effect of the suction port 1421 are identical to those in the above-described implementation. Thus, with respect to a description thereof, the description about the above-described implementation may be referred to.

However, in this implementation, like the implementation described above with reference to FIG. 11, the suction valve 147 is included in the suction port 1421, but in this implementation, the suction valve 147 may be included in the valve pipe 146. Accordingly, since the suction valve 147 may smoothly and quickly operate, when the compressor stops, reverse rotation of an orbiting scroll during a stop of the compressor may be suppressed, and refrigerant or oil may be also quickly suppressed from flowing back.

In detail, in this implementation, the valve pipe 146 having a hollow shape may be inserted into the suction port 1421, and an end of the valve pipe 146 connected to the refrigerant suction pipe 115 may be fully open and another end thereof at an opposite side may have a partially or fully closed shape. A refrigerant through hole 146*a* having an open side is provided near the other end of the valve pipe 146. The refrigerant through hole 146*a* is located between the outlet end 1421*b* of the suction port 1421 and the outer circumferential surface of the fixed wrap 144 facing the outlet end 1421*b*. Accordingly, the refrigerant through hole 146*a* in the valve pipe 146 may communicate with the suction pressure chamber Vs.

The suction valve 147 may be slidably inserted into the valve pipe 146 in a longitudinal direction of the valve pipe 146. Thus, the suction valve 147 slides along the valve pipe 146 due to a pressure difference between both sides to thereby open or close the refrigerant through hole 146*a*.

An elastic member 148 such as a compression coil spring may be provided at a rear side of the suction valve 147, that is, between the other side of the valve pipe 146 and a rear surface of the suction valve 147 facing the other side of the valve pipe 146. Thus, when the compressor stops, the suction valve 147 quickly moves toward the refrigerant suction pipe 115 to quickly block the refrigerant through hole 146*a*. Thus, the orbiting wrap 152 or the fixed wrap engaged therewith may be suppressed from being damaged due to reverse rotation of the orbiting scroll 150, and refrigerant and oil in the discharge pressure chamber Vd or the intermediate pressure chamber Vm may be also suppressed from flowing back into the suction pressure chamber Vs, and thus being spilled into the refrigerant suction pipe 115.

In addition, in this case, the outlet end 1421*b* of the suction port 1421, in other words, the suction end 144*a* of the fixed wrap 144 may be provided such that the reinforcing unit 145 radially overlaps the suction port 1421. Since the reinforcing unit 145 are identical to that in the above-described implementations, a detailed description thereof is not provided here.

In addition, in this case, the suction guide groove 1452 may be provided in the reinforcing unit 145. Like the above-described implementations of FIGS. 7 and 11, the suction guide groove 1452 is elongated in a radial direction (or a direction toward the fixed wrap 144), and a cross-sectional area of the suction guide groove 1452 may be provided to be nearly equal to a cross-sectional area of the suction valve 146 to accommodate the suction valve 146. Accordingly, as an end of the valve pipe 146 equipped with the suction valve 147 is inserted deep into the valve accommodating groove 1452, an area of the refrigerant through hole 146*a* is ensured at maximum, and thus, suction loss may be minimized.

However, in this case, a suction guide surface 1421*c* may be further provided at a downstream side corner of the outlet end 1421*b* of the suction port 1421. The suction guide surface 1421*c* may be provided to be inclined from inside to outside of the suction port 1421 such that an inner diameter of the suction port 1421 increases. Accordingly, a large longitudinal width of the refrigerant through hole 146*a* in an outer circumferential surface of the valve pipe 146 may be ensured to reduce suction resistance with respect to refrigerant.

What is claimed is:

1. A scroll compressor comprising:

a casing;

a driving motor positioned inside the casing;

a rotation shaft coupled to a rotor of the driving motor;

an orbiting scroll coupled to the rotating shaft in the casing and including an orbiting wrap configured to orbit;

a fixed scroll positioned in the casing and including a fixed wrap configured to engage the orbiting wrap and define a compression chamber having a helical form;

a suction port being inserted through the fixed scroll from an outer circumferential surface of the fixed scroll to an inner circumferential surface of the fixed scroll toward an outer side surface of the fixed wrap, the suction port being in fluid communication with the compression chamber; and a refrigerant suction pipe extending through the casing and inserted into an inlet end of the suction port, wherein a reinforcing unit is provided between an outlet end of the suction port and an outer circumferential surface of the fixed wrap facing the outlet end of the suction port, wherein the reinforcing unit extends from the outlet end of the suction port toward the outer circumferential surface of the fixed wrap, and wherein the reinforcing unit overlaps a part of the outlet end of the suction port in a radial direction.

2. The scroll compressor of claim 1, wherein a discharge port is provided at a center portion of the fixed scroll, and wherein the reinforcing unit extends along a circumference of the suction port from a downstream end of the outlet end of the suction port to an upstream end at an opposite side of the downstream end, the downstream end being spaced far apart from the discharge port along a direction in which the fixed wrap extends.

3. The scroll compressor of claim 2, wherein the reinforcing unit overlaps 50% or less of an inner diameter of the suction port.

4. The scroll compressor of claim 1, wherein the reinforcing unit includes a suction guide groove recessed from the outlet end of the suction port toward the outer circumferential surface of the fixed wrap.

5. The scroll compressor of claim 4, wherein the suction guide groove is inclined from a side of the outlet end of the suction port toward the fixed wrap.

6. The scroll compressor of claim 5, wherein the suction guide groove has a plane shape or a circumferential shape.

7. The scroll compressor of claim 4, wherein the suction guide groove is radially recessed at the outlet end of the suction port.

8. The scroll compressor of claim 7, wherein the suction guide groove has a flat radial side surface.

9. The scroll compressor of claim 1, wherein the fixed scroll comprises:

a fixed end plate including a discharge port at a center portion of the fixed end plate; and a fixed side wall provided at a side surface of the fixed end plate, having an annular shape, and surrounding the fixed wrap, wherein the reinforcing unit includes a circular arc surface having an inflection point, the inflection point connecting a suction end of the fixed wrap to an inner circumferential surface of the fixed side wall and being located within a circumferential range of the suction port.

10. The scroll compressor of claim 9, wherein the inflection point is spaced far apart from the discharge port with reference to a first center line passing through a center of the suction port.

11. The scroll compressor of claim 10, wherein the inflection point is provided at a position such that an overlapping length from an end of the reinforcing unit to an end of the suction port located far apart from the discharge port is 50% or less of an inner diameter of the suction port.

12. The scroll compressor of claim 1, wherein the suction port comprises a suction valve configured to open or close the suction port.

13. The scroll compressor of claim 12, wherein the suction valve comprises:

a valve pipe being open toward the compression chamber and inserted into the suction port; and a valve member detachably attached to an end of the valve pipe and configured to hinge relative to the valve pipe and open or close the suction port.

14. The scroll compressor of claim 12, wherein the suction valve comprises:

a valve pipe including a suction through-hole being open toward the compression chamber and inserted into the suction port; and a valve member slidably inserted into the valve pipe and configured to open or close the suction through-hole and open or close the suction port.

15. The scroll compressor of claim 1, wherein the suction port is provided in a circumferential direction with reference to an axial center of the rotating shaft.

16. The scroll compressor of claim 1, wherein the suction port is inclined in a direction toward a center of the fixed scroll with reference to a direction in which the fixed wrap extends, the suction port being offset from an axial center of the rotating shaft.

17. The scroll compressor of claim 1, wherein the suction port comprises a first suction unit defining the inlet end and a second suction unit defining the outlet end, and wherein a cross-sectional area of the second suction unit is larger than a cross-sectional area of the first suction unit.

18. A scroll compressor comprising:

an orbiting scroll including an orbiting wrap;

a fixed scroll including a fixed wrap configured to engage the orbiting wrap and define a compression chamber;

a suction port being inserted through the fixed scroll from an outer circumferential surface of the fixed scroll to an inner circumferential surface of the fixed scroll toward an outer side surface of the fixed wrap, the suction port being in fluid communication with the compression chamber; and a refrigerant suction pipe inserted into an inlet end of the suction port, wherein a reinforcing unit is provided between an outlet end of the suction port and an outer circumferential surface of the fixed wrap facing the outlet end of the suction port, wherein the reinforcing unit extends from the outlet end of the suction port toward the outer circumferential surface of the fixed wrap, and wherein the reinforcing unit overlaps a part of the outlet end of the suction port in a radial direction.

19. The scroll compressor of claim 18, wherein a discharge port is provided at a center portion of the fixed scroll, and wherein the reinforcing unit extends along a circumference of the suction port from a downstream end of the outlet end of the suction port to an upstream end at an opposite side of the downstream end, the downstream end being spaced far apart from the discharge port along a direction in which the fixed wrap extends.

20. The scroll compressor of claim 19, wherein the reinforcing unit overlaps 50% or less of an inner diameter of the suction port.

* * * * *